US011807926B2

(12) United States Patent
Ebata

(10) Patent No.: US 11,807,926 B2
(45) Date of Patent: Nov. 7, 2023

(54) COPPER ALLOY SLIDING MATERIAL

(71) Applicant: TAIHO KOGYO CO., LTD., Toyota (JP)

(72) Inventor: Yuhei Ebata, Toyota (JP)

(73) Assignee: TAIHO KOGYO CO., LTD., Toyota (JP)

( * ) Notice: Subject to any disclaimer, the term of this patent is extended or adjusted under 35 U.S.C. 154(b) by 56 days.

(21) Appl. No.: 17/639,095

(22) PCT Filed: Oct. 14, 2020

(86) PCT No.: PCT/JP2020/038714
§ 371 (c)(1),
(2) Date: Feb. 28, 2022

(87) PCT Pub. No.: WO2021/075447
PCT Pub. Date: Apr. 22, 2021

(65) Prior Publication Data

US 2022/0298603 A1 Sep. 22, 2022

(30) Foreign Application Priority Data

Oct. 16, 2019 (JP) ..... 2019-189103

(51) Int. Cl.
*C22C 9/02* (2006.01)
*C22C 12/00* (2006.01)
*B22F 1/00* (2022.01)

(52) U.S. Cl.
CPC ..... *C22C 9/02* (2013.01); *B22F 1/00* (2013.01); *C22C 12/00* (2013.01)

(58) Field of Classification Search
CPC ..... C22C 9/02
See application file for complete search history.

(56) References Cited

U.S. PATENT DOCUMENTS 10,876,576 B2 * 12/2020 Toda ..... C22C 1/02
2001/0021353 A1 9/2001 Sakai et al.
(Continued)

FOREIGN PATENT DOCUMENTS

BR PI 0721845-1 A2 2/2009
CN 1910300 A 2/2007
(Continued)

OTHER PUBLICATIONS

Office Action dated Mar. 10, 2023 in Chinese Application No. 202080062832.X.
(Continued)

*Primary Examiner* — Christopher S Kessler
(74) *Attorney, Agent, or Firm* — Sughrue Mion, PLLC

(57) ABSTRACT

[Object] To improve both abrasion resistance and seizure resistance.
[Solution] A copper alloy sliding material is configured, which contains 0.5 to 12.0 mass % of Sn, 2.0 to 8.0 mass % of Bi, and 1.0 to 5.0 vol % of an inorganic compound, the balance being Cu and inevitable impurities, wherein the inorganic compound includes a first inorganic compound having an average particle size of 0.5 to 3.0 μm and a second inorganic compound having an average particle size of 4.0 to 20.0 μm, and wherein a value obtained by dividing a volume fraction of the first inorganic compound by a volume fraction of the second inorganic compound is 0.1 to 1.0.

2 Claims, 3 Drawing Sheets

Example 12

(56) References Cited

U.S. PATENT DOCUMENTS

| | | | | |
|---|---|---|---|---|
| 2008/0166578 | A1* | 7/2008 | Saxton | C22C 32/0047 419/10 |
| 2010/0266444 | A1 | 10/2010 | Yokota et al. | |
| 2012/0114971 | A1 | 5/2012 | Andler et al. | |
| 2012/0294750 | A1 | 11/2012 | Yokota et al. | |
| 2014/0272128 | A1 | 9/2014 | Saxton et al. | |

FOREIGN PATENT DOCUMENTS

| | | | |
|---|---|---|---|
| CN | 1932057 | A | 3/2007 |
| CN | 101001966 | A | 7/2007 |
| CN | 101107376 | A | 1/2008 |
| CN | 101541989 | A | 9/2009 |
| CN | 101636513 | A | 1/2010 |
| CN | 101688268 | A | 3/2010 |
| CN | 101801567 | A | 8/2010 |
| CN | 102272468 | A | 12/2011 |
| CN | 102471832 | A | 5/2012 |
| CN | 103080381 | A | 5/2013 |
| CN | 104039995 | A | 9/2014 |
| CN | 106077683 | A | 11/2016 |
| CN | 106321635 | A | 1/2017 |
| CN | 108699632 | A | 10/2018 |
| EP | 2 048 253 | A1 | 4/2009 |
| EP | 2 185 303 | A1 | 5/2010 |
| GB | 2 355 016 | A | 4/2001 |
| GB | 2 359 822 | A | 9/2001 |
| JP | 11124646 | A | 5/1999 |
| JP | 2001-81523 | A | 3/2001 |
| JP | 2001-240925 | A | 9/2001 |
| JP | 3421724 | B2 | 6/2003 |
| JP | 2010-535287 | A | 11/2010 |
| JP | 2013-49887 | A | 3/2013 |
| JP | 5328353 | B2 | 10/2013 |
| JP | 2016-79432 | A | 5/2016 |
| KR | 10-2009-0028638 | A | 3/2009 |
| KR | 10-2010-0065288 | A | 6/2010 |
| RU | 2010 105 926 | A | 9/2011 |
| WO | 2008/018348 | A1 | 2/2008 |
| WO | 2009/017501 | A1 | 2/2009 |

OTHER PUBLICATIONS

International Search Report dated Dec. 22, 2020 in International Application No. PCT/JP2020/038714.

Written Opinion of the International Searching Authority dated Dec. 22, 2020 in International Application No. PCT/JP2020/038714.

Office Action dated Oct. 4, 2022 from the Japanese Patent Office in JP Application No. 2019-189103.

Office Action dated Jun. 24, 2022, issued in Chinese Application No. 202080062832.X.

* cited by examiner

Example 12

Comparative Example 1

COPPER ALLOY SLIDING MATERIAL

CROSS REFERENCE TO RELATED APPLICATIONS

This application is a National Stage of International Application No. PCT/JP2020/038714 filed Oct. 14, 2020, claiming priority based on Japanese Patent Application No. 2019-189103 filed Oct. 16, 2019.

TECHNICAL FIELD

The present invention relates to a copper alloy sliding material.

BACKGROUND ART

Conventionally, there is known a technique in which a sliding member is provided on a contact surface when relative movement occurs between various members. As the sliding member, various materials are known, and a sliding member in which various materials are added into a Cu matrix is known. For example, Patent Literature 1 discloses a configuration in which an Sn, Bi, and Fe—P based compound is added to a Cu matrix.

CITATIONS LIST

Patent Literature

Patent Literature 1: JP 5328353 B

SUMMARY OF INVENTION

Technical Problems

In some cases, it has been desired to further improve both abrasion resistance and seizure resistance as compared with those in conventional techniques. That is, in conventional techniques, an Fe—P based compound is a hard substance, and enhances the abrasion resistance, but the seizure resistance may not be improved only by a hard substance added for enhancing the abrasion resistance. That is, when a plastic flow of Cu occurs in the Cu matrix, Bi is covered with Cu, and also Bi in Cu falls off. As a result, Bi decreases on a sliding surface. Hereinafter, such a decrease is referred to as a decrease in Bi on the sliding surface. When the decrease in Bi on the sliding surface occurs, the improvement in seizure resistance by Bi cannot be expected.

Solutions to Problems

The copper alloy sliding material of the present invention is a copper alloy sliding material containing 0.5 to 12.0 mass % of Sn, 2.0 to 8.0 mass % of Bi, and 1.0 to 5.0 vol % of an inorganic compound, the balance being Cu and inevitable impurities, wherein the inorganic compound includes a first inorganic compound having an average particle size of 0.5 to 3.0 μm and a second inorganic compound having an average particle size of 4.0 to 20.0 μm, and wherein a value obtained by dividing a volume fraction of the first inorganic compound by a volume fraction of the second inorganic compound is 0.1 to 1.0.

In the copper alloy sliding material, Sn is added to enhance strength of a Cu alloy. However, when a content of Sn is less than 0.5 mass %, an effect of enhancing strength of a Cu alloy matrix cannot be obtained. When the content of Sn exceeds 12.0 mass %, the Cu alloy matrix becomes hard and brittle. Therefore, the content of Sn is set to 0.5 to 12.0 mass %.

Bi is added to bring about a lubricating action for low-melting-point soft metals, when coming into contact with a counter material. However, when a content of Bi is less than 2.0 mass %, it is difficult to obtain the lubricating action for low-melting-point soft metals. In addition, when the content of Bi exceeds 8.0 mass %, the seizure resistance is deteriorated. That is, Bi is relatively soft, and thus, when an amount of Bi that can come into contact with the counter material increases, a portion where Bi exists collectively and the counter material come into contact with each other, so that the Bi existing collectively may fall off from the surface. When Bi excessively falls off from the surface, Cu covers the portion where Bi has fallen off, and thus an amount of Bi present on the contact surface with the counter material tends to become excessively small. That is, the decrease in Bi on the sliding surface occurs. In this case, the lubricating action for low-melting-point soft metals due to Bi is deteriorated as compared with that before start of contact with the counter material, so that the seizure resistance is deteriorated. Therefore, the content of Bi is set to 2.0 to 8.0 mass %.

Inorganic compounds have different average particle sizes. That is, the inorganic compound includes a first inorganic compound having an average particle size of 0.5 to 3.0 μm which is relatively small, and a second inorganic compound having an average particle size of 4.0 to 20.0 μm which is relatively large. When inorganic compounds having different average particle sizes are contained as described above, different effects can be obtained due to the respective inorganic compounds.

That is, assuming cases where two kinds of inorganic compounds having the same amount and different average particle sizes are individually dispersed in the Cu matrix, the inorganic compound having a small average particle size is more easily dispersed in the Cu matrix than that having a large average particle size. Therefore, an inter-particle distance between inorganic compounds is smaller on average when the average particle size is small than when the average particle size is large, and the inorganic compounds that can inhibit the plastic flow of Cu are uniformly dispersed. As a result, the inorganic compound having a small average particle size effectively suppresses the plastic flow of Cu and suppresses the decrease in Bi on the sliding surface. Therefore, it is possible to effectively suppress a deterioration in lubricating action for low-melting-point soft metals due to Bi.

As described above, suppression of the plastic flow of Cu can effectively provide the lubricating action for low-melting-point soft metals due to Bi, and can improve the seizure resistance. In particular, in a case where the counter material is a shaft and the copper alloy sliding material is used as a bearing, when partial contact occurs in which the shaft locally comes into contact with the bearing, a state of partial contact occurs in which a large load is locally applied in the copper alloy sliding material. In a state where the plastic flow of Cu is suppressed by the inorganic compound having a small average particle size and the seizure resistance is improved, the plastic flow of Cu can be effectively suppressed even in a state where partial contact occurs. As a result, even in a state where partial contact occurs, the decrease in Bi on the sliding surface can be suppressed, and the deterioration in lubricating action for low-melting-point soft metals due to Bi can be effectively suppressed.

On the other hand, when the inorganic compounds come into contact with the counter material, the inorganic compounds harder than Cu or Bi may come into contact with the counter material, and thus the abrasion resistance of the copper alloy sliding material can be improved as compared with the case where the inorganic compounds do not come into contact with the counter material. In addition, in a case where the average particle size is large, an area capable of receiving a load from the counter material is large and it is easy to withstand a high load, as compared with the case where the average particle size is small. As a result, the abrasion resistance can be improved.

Furthermore, a value obtained by dividing a volume fraction of the first inorganic compound by a volume fraction of the second inorganic compound is 0.1 to 1.0. That is, a vol % of the first inorganic compound is equal to or less than a vol % of the second inorganic compound, and a volume of the first inorganic compound is at least ⅒ of a volume of the second inorganic compound. That is, the first inorganic compound exists, in a dispersed state, in the Cu matrix to inhibit the plastic flow of Cu. However, when contained in an excessively large amount, the first inorganic compound inhibits Cu-to-Cu joining, so that the Cu matrix is inhibited from being brought into an integrated state. For example, it becomes difficult to manufacture the copper alloy sliding material as a sintered body. Therefore, a ratio of the first inorganic compound is configured so as not to be excessively high relative to the second inorganic compound. In addition, when the ratio of the first inorganic compound is excessively small, it becomes difficult to suppress the plastic flow of Cu. Therefore, the volume of the first inorganic compound is ⅒ or more of the volume of the second inorganic compound.

DESCRIPTION OF EMBODIMENTS

Figure 1:
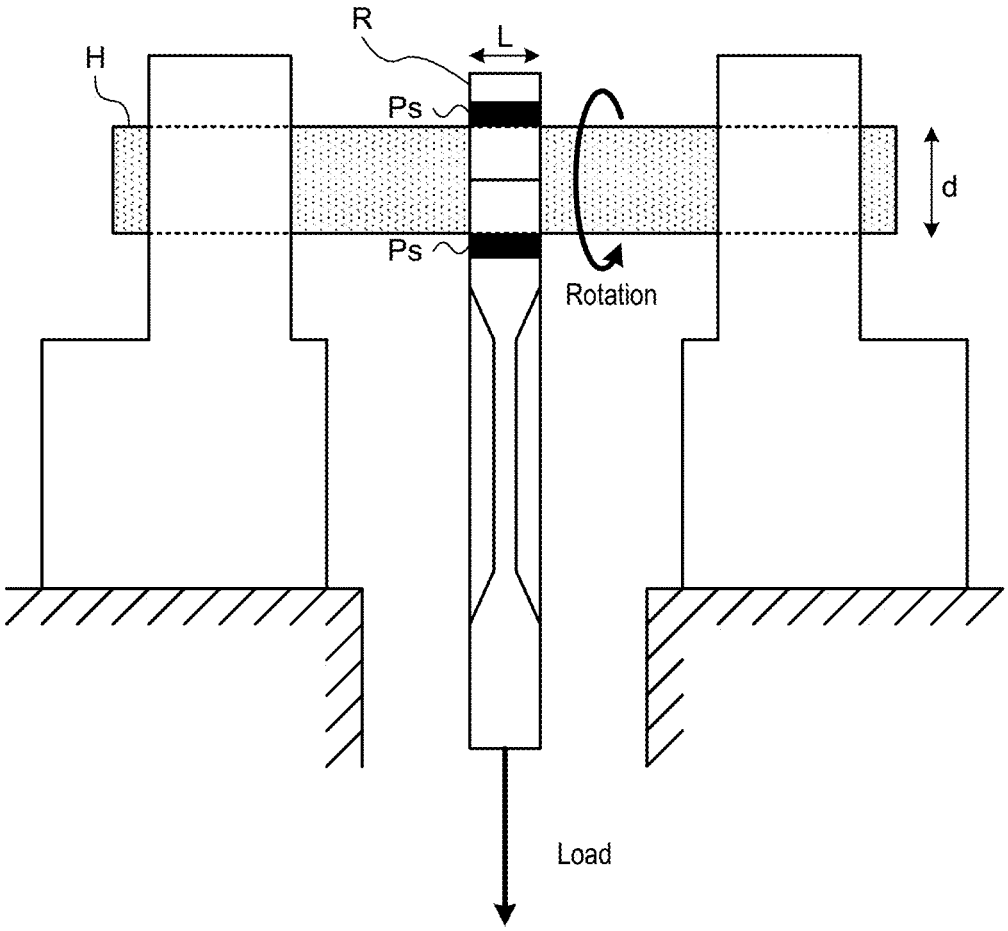
FIG. 1 is a schematic diagram of a sliding tester.

An embodiment of the present invention will be described in the following order.

(1) Method for manufacturing copper alloy sliding material:

(2) Test result:

(3) Other embodiments:

(1) Method for Manufacturing Copper Alloy Sliding Material

In an embodiment of the present invention, a copper alloy sliding material is manufactured by mixing an inorganic compound with a powder containing Cu—Sn—Bi and sintering the mixture. Such a manufacture method is realized, for example, by mixing an inorganic compound such as chromium nitride or titanium nitride with a Cu—Sn—Bi-based alloy powder and sintering the mixture. Specifically, the Cu—Sn—Bi-based alloy powder is produced by pulverizing a preliminary alloy adjusted to have a predetermined composition (which will be described later) by an atomization method, and then classifying the powder into a powder particle size of 150 μm or less.

Further, the powder of the inorganic compound is adjusted so as to attain a predetermined vol % (which will be described later) with respect to the whole of the powder and Cu—Sn—Bi. Further, the Cu—Sn—Bi-based alloy powder and the inorganic compound powder are mixed for 20 to 50 minutes by a V blender to obtain a mixed powder. Next, the mixed powder is sprayed on a base material (for example, a material which serves as a back metal of the bearing) such as steel so that a thickness of the mixture is 1 to 3 mm, and primary sintering is performed by an electric furnace in a reducing gas+nitrogen gas atmosphere. A sintering temperature is 700° C. to 900° C., and a sintering time is 5 to 30 minutes. In the present embodiment, a sintered layer is densified by rolling, and secondary sintering is performed again under the same conditions. Finally, finish rolling is performed, and a final thickness of the sintered layer is 0.3 to 1.0 mm.

Compositions of the Cu—Sn—Bi-based alloy powder and the inorganic compound powder may be determined so that a content of Sn is 0.5 to 12.0 mass %, a content of Bi is 2.0 to 8.0 mass %, and a content of the inorganic compound is 1.0 to 5.0 vol % in the final sintered layer. For example, a total weight of the sintered layer to be produced is determined, and the mass % of Sn is selected from 0.5 to 12.0 mass % and the mass % of Bi is selected from 2.0 to 8.0 mass %. As a result, masses of Cu, Sn, Bi, and the inorganic compound are determined. The Cu—Sn—Bi-based alloy powder having the predetermined composition is produced by Cu, Sn, and Bi having the thus-determined weights.

In addition, a total volume of the sintered layer to be produced is determined, the vol % of the inorganic compound is selected from 1.0 to 5.0 vol %, and the mass of the inorganic compound (amounts of two kinds of inorganic compounds which will be described later) is determined so as to attain the selected vol %. Then, an inorganic compound powder having a predetermined average particle size is purchased, and the mass of the inorganic compound determined as described above is weighed, whereby the inorganic compound powder can be prepared so as to attain the predetermined vol %. In the present embodiment, two kinds of inorganic compounds are prepared. That is, the first inorganic compound having an average particle size of 0.5 to 3.0 μm and the second inorganic compound having an average particle size of 4.0 to 20.0 μm are prepared as the inorganic compound powders.

The first inorganic compound has an average particle size smaller than that of the second inorganic compound. In the present embodiment, the first inorganic compound suppresses the plastic flow of Cu when the copper alloy sliding material is formed on the surface of the sliding member and used as the sliding member. That is, the inorganic compound having a small average particle size is more easily dispersed in the Cu matrix than the inorganic compound having a large average particle size. The presence of the inorganic compound at a grain boundary of Cu inhibits the plastic flow of Cu. Therefore, when the inorganic compound is uniformly dispersed in the Cu matrix, the plastic flow is inhibited in the entire Cu matrix. On the other hand, when the inorganic compound is localized in the Cu matrix, a plastic flow is likely to occur in a portion where the inorganic compound is not present in the Cu matrix. Thus, the inorganic compound having a small average particle size effectively suppresses the plastic flow of Cu and suppresses the decrease in Bi on the sliding surface, as compared with the inorganic compound having a large average particle size. Therefore, it is possible to effectively suppress a deterioration in lubricating action for low-melting-point soft metals due to Bi.

The suppression of the plastic flow of Cu as described above occurs when the average particle size of the inorganic compound is 0.5 to 3.0 μm. That is, when the average particle size is less than 0.5 μm, the inorganic compounds are easily aggregated with each other, and homogeneous dispersion becomes difficult, so that the effect of suppressing the plastic flow is hardly obtained. In addition, when the average particle size is more than 3.0 μm, the inorganic compounds become excessively large, and the inter-particle distance becomes long, so that the effect of suppressing the plastic flow is hardly obtained.

Therefore, in the present embodiment, the average particle size of the first inorganic compound is set to 0.5 to 3.0 μm. As a result, a suppressed plastic flow of Cu can effectively exhibit the lubricating action for low-melting-point soft metals due to Bi, and can improve the seizure resistance. In particular, in a case where the counter material is a shaft and the copper alloy sliding material and base material are used as a bearing, even when partial contact occurs in which the shaft locally comes into contact with the bearing, the plastic flow of Cu can be effectively suppressed. As a result, even in a state where partial contact occurs, the decrease in Bi on the sliding surface can be suppressed, and the deterioration in lubricating action for low-melting-point soft metals due to Bi can be effectively suppressed.

On the other hand, when the copper alloy sliding material is formed on the surface of the sliding member and used as the sliding member, a substance present on the surface in the copper alloy sliding material may come into contact with the counter material. Then, when the inorganic compound in the copper alloy sliding material comes into contact with the counter material, the inorganic compound harder than Cu or Bi comes into contact with the counter material. Therefore, the abrasion resistance of the copper alloy sliding material can be improved as compared with the case where the inorganic compound does not come into contact with the counter material.

In addition, in a case where the average particle size is large, an area capable of receiving a load from the counter material is large and it is easy to withstand a high load, as compared with the case where the average particle size is small. As a result, the abrasion resistance can be further improved. Therefore, in the present embodiment, the average particle size of the second inorganic compound is set to 4.0 to 20.0 μm. When the average particle size is less than 4.0 μm, the second inorganic compound is easily taken into an abrasion powder during formation of the abrasion powder, and the effect of improving the abrasion resistance is hardly obtained. In addition, if the average particle size is more than 20.0 μm, machinability will be significantly deteriorated.

In the present embodiment, the amount of the inorganic compound is 1.0 to 5.0 vol %. That is, in the present embodiment, the inorganic compound is mixed for improving the seizure resistance and improving the abrasion resistance. When the amount of the inorganic compound is excessively small, these properties are not improved, and therefore the amount of the inorganic compound is 1.0 vol % or more. On the other hand, when the amount of the inorganic compound is excessively large, adverse effects such as difficulty in integrally forming the Cu matrix and a decrease in strength occur. Therefore, the amount of the inorganic compound is 5.0 vol % or less.

Furthermore, a value obtained by dividing a volume fraction of the first inorganic compound by a volume fraction of the second inorganic compound is 0.1 to 1.0. That is, a vol % of the first inorganic compound is equal to or less than a vol % of the second inorganic compound, and a volume of the first inorganic compound is at least 1/9 of a volume of the second inorganic compound. That is, the first inorganic compound is configured so as not to have a volume larger than that of the second inorganic compound.

That is, the first inorganic compound exists, in a dispersed state, in the Cu matrix to inhibit the plastic flow of Cu. However, when contained in an excessively large amount, the first inorganic compound inhibits Cu-to-Cu joining. Furthermore, the first inorganic compound has a small average particle size, and thus can exist, in a dispersed state, in the Cu matrix even though its volume is not large. Therefore, the first inorganic compound is configured such that its volume is not larger than that of the second inorganic compound. However, when the ratio of the first inorganic compound is excessively small, it becomes difficult to suppress the plastic flow of Cu. Thus, the amount of the inorganic compound powder is adjusted so that the volume of the first inorganic compound is at least 1/9 or more of the volume of the second inorganic compound.

(2) Test Result

Hereinafter, results of tests performed on a copper alloy sliding material manufactured as a sintered layer by the above-described manufacture method will be described. Table 1 shows mass % of Sn and Bi, average particle sizes and vol % of inorganic compounds, characteristics of each material, and test results in Examples 1 to 12 and Comparative Examples 1 to 5.

TABLE 1

| | No. | mass % Amount of Sn | mass % Amount of Bi | μm $Cr_2N$ | μm TiN | vol % $Cr_2N$ | vol % TiN | — Small/ large | vol % Total amount of inorganic compounds | HV Inorganic compound hardness | HV Overall material hardness | MPa Seizure surface pressure | μm Abrasion depth |
|---|---|---|---|---|---|---|---|---|---|---|---|---|---|
| Example | 1 | 4.0 | 5.0 | 5.5 | 2.5 | 3.0 | 0.5 | 0.17 | 3.5 | $Cr_2N$: 1400 TiN: 1900 | 115 | 65 | 2.6 |
| | 2 | 7.0 | 5.0 | 4.5 | 2.5 | 3.0 | 0.5 | 0.17 | 3.5 | $Cr_2N$: 1400 TiN: 1900 | 110 | 60 | 2.0 |
| | 3 | 10.0 | 5.0 | 4.5 | 2 | 3.0 | 0.5 | 0.17 | 3.5 | $Cr_2N$: 1400 TiN: 1900 | 130 | 60 | 1.9 |
| | 4 | 7.0 | 2.0 | 4.5 | 2 | 3.0 | 0.5 | 0.17 | 3.5 | $Cr_2N$: 1400 TiN: 1900 | 130 | 80 | 2.3 |
| | 5 | 7.0 | 8.0 | 5 | 2 | 3.0 | 0.5 | 0.17 | 3.5 | $Cr_2N$: 1400 TiN: 1900 | 120 | 57 | 1.9 |

TABLE 1-continued

| | No. | mass % Amount of Sn | mass % Amount of Bi | μm $Cr_2N$ | μm TiN | vol % $Cr_2N$ | vol % TiN | — Small/ large | vol % Total amount of inorganic compounds | HV Inorganic compound hardness | HV Overall material hardness | MPa Seizure surface pressure | μm Abrasion depth |
|---|---|---|---|---|---|---|---|---|---|---|---|---|---|
| | 6 | 7.0 | 5.0 | 4 | 2 | 1.5 | 0.5 | 0.33 | 2.0 | $Cr_2N$: 1400 TiN: 1900 | 130 | 65 | 2.6 |
| | 7 | 7.0 | 5.0 | 5 | 2 | 4.5 | 0.5 | 0.11 | 5.0 | $Cr_2N$: 1400 TiN: 1900 | 130 | 65 | 1.3 |
| | 8 | 7.0 | 5.0 | 6.5 | 2.5 | 3.0 | 1.0 | 0.33 | 4.0 | $Cr_2N$: 1400 TiN: 1900 | 130 | 65 | 1.4 |
| | 9 | 7.0 | 5.0 | 5.5 | 2.5 | 0.5 | 0.5 | 1.00 | 1.0 | $Cr_2N$: 1400 TiN: 1900 | 130 | 65 | 3.0 |
| | 10 | 4.0 | 2.0 | 5 | 2 | 1.5 | 1.0 | 0.67 | 2.5 | $Cr_2N$: 1400 TiN: 1900 | 130 | 78 | 2.3 |
| | 11 | 4.0 | 2.0 | 4 | 2 | 4.0 | 0.3 | 0.08 | 4.3 | $Cr_2N$: 1400 TiN: 1900 | 120 | 76 | 2.3 |
| | 12 | 10.0 | 2.0 | 5 | 2.5 | 4.0 | 1.0 | 0.25 | 5.0 | $Cr_2N$: 1400 TiN: 1900 | 140 | 90 | 1.5 |
| Comparative Example | 1 | 4.0 | 5.0 | $Fe_3P$: 12.0 | — | $Fe_3P$: 2.5 | — | — | 2.5 | $Fe_3P$: 800 | 80 | 15 | 9.0 |
| | 2 | 10.0 | 5.0 | — | $Mo_2C$: 2.0 | — | $Mo_2C$: 1.5 | — | 1.5 | $Mo_2C$: 1400 | 140 | 57 | 3.0 |
| | 3 | 15.0 | 5.0 | 5 | 2 | 3.0 | 1.0 | 0.33 | 4.0 | $Cr_2N$:1400 TiN: 1900 | 115 | 40 | 3.1 |
| | 4 | 7.0 | 10.0 | 6 | 2 | 3.0 | 1.0 | 0.33 | 4.0 | $Cr_2N$: 1400 TiN: 1900 | 95 | 50 | 2.8 |
| | 5 | 7.0 | 5.0 | 5 | 2 | 0.3 | 0.4 | 1.60 | 0.7 | $Cr_2N$: 1400 TiN: 1900 | 105 | 57 | 3.4 |

In the Examples and Comparative Examples 3 to 5 shown in Table 1, the first inorganic compound is TiN, and the second inorganic compound is $Cr_2N$. In Table 1, the average particle sizes of the inorganic compounds are indicated in columns indicated as μm. In Examples 1 to 12 and Comparative Examples 3 to 5, the average particle size of TiN as the first inorganic compound is 2.0 to 2.5 μm, and the average particle size of $Cr_2N$ as the second inorganic compound is 4.0 to 6.5 μm. In Comparative Examples 1 and 2, the inorganic compound used is one kind, and the average particle size is also one kind. That is, Comparative Examples 1 contains $Fe_3P$ having an average particle size of 12.0 μm as the inorganic compound, and Comparative Examples 2 contains $Mo_2C$ having an average particle size of 2.5 μm as the inorganic compound.

Further, as shown in Table 1, in Examples 1 to 12, a vol % of TiN as the first inorganic compound is 0.3 to 1.0%, and a vol % of $Cr_2N$ as the second inorganic compound is 0.5 to 4.5%. Furthermore, as shown in Table 1, in Examples 1 to 12, a value obtained by dividing a volume fraction (vol %) of the first inorganic compound by a volume fraction (vol %) of the second inorganic compound is 0.1 (0.08) to 1.0. Furthermore, as shown in Table 1, in Examples 1 to 12, a sum of the volume fraction (vol %) of the first inorganic compound and the volume fraction of the second inorganic compound is 0.1 to 5.0 vol %.

The average particle size of the inorganic compound shown in Table 1 is an average particle size obtained by observing the manufactured copper alloy sliding material. In embodiments shown in Table 1, values measured based on optical micrographs are indicated. That is, in the present embodiment, structure photographs were taken with an optical microscope (GX 51 manufactured by Olympus Corporation) at a magnification of 400 times, for a plurality of (for example, 6) surfaces or cross sections of Examples 1 to 12 and Comparative Examples 1 to 6.

Furthermore, image processing of extracting the inorganic compounds from the structure photographs was performed. Image analysis software (LUZEX_AP manufactured by NIRECO CORPORATION) was used for the image processing. Further, binarization processing for distinguishing the extracted inorganic compounds from a remaining part was performed, and equivalent circle diameters and area rates of the inorganic compounds were measured. As a result, the equivalent circle diameter was regarded as the particle size, and the area % was regarded as the vol %. In the image analysis, for example, the first inorganic compound and the second inorganic compound can be distinguished from each other based on a difference in color tone. Of course, the inorganic compounds may be distinguished through mapping by SEM-EDS or the like.

Comparative Examples 1 and 2 are different from Examples 1 to 12 in that Comparative Examples 1 and 2 contain one kind of inorganic compound, $Fe_3P$ and $Mo_2C$, respectively. Comparative Example 3 is different from Examples 1 to 12 in containing 15.0 mass % of Sn. Comparative Example 4 is different from Examples 1 to 12 in containing 10.0 mass % of Bi. Furthermore, Comparative Example 5 is different from Examples 1 to 12 in that the value obtained by dividing the volume fraction of the first inorganic compound by the volume fraction of the second inorganic compound is 1.6.

In Table 1, information on the hardnesses of Examples 1 to 12 and Comparative Examples 1 to 5 is included. The hardness of the inorganic compound indicates Vickers hardness when each inorganic compound is present alone, and can be specified, for example, by converting a measurement result obtained by a nanoindenter into Vickers hardness (as for the conversion, see, for example, Shota ARA et al., The 61th National Congress of Theoretical and Applied Mechanics, "Fundamental Study on Mechanical Property Evaluation of Crystal Grain by Nano-indentation"). Furthermore, the Vickers hardnesses of Examples 1 to 12 and Comparative Examples 1 to 5 are indicated as "overall material hardness".

The surface pressure at seizure is a result of a seizure resistance test (test of surface pressure at seizure). The seizure resistance test was performed in a state where the copper alloy sliding material was used as a bearing. That is, by the above-described manufacture method, the copper alloy sliding material is formed on a base material which has a shape obtained by cutting a cylinder in an axial direction and forms a cylinder when the cut pieces are combined, and a bearing is manufactured.

FIG. 1 is an explanatory diagram of a tester. Specifically, as shown in FIG. 1, a housing block R formed with a through hole through which a test shaft H (hatched) can pass was prepared, and the test shaft H was borne in the through hole. Bearings Ps (black) of Examples 1 to 12 and Comparative Examples 1 to 5 were mounted on an inner periphery of the through hole of the housing block R to bear the test shaft H. Since the housing block R is a substitute for a connecting rod, a connecting rod may be used. In this test, a diameter d of the test shaft H is 40 mm, and a length L of the bearing Ps in the axial direction of the test shaft H is 10 mm. In addition, a thickness of the copper alloy sliding material on the base material is 0.6 mm.

The tester was utilized to bear the test shaft H on both outer sides of the housing block R in the axial direction of the test shaft H, and to rotate the test shaft H at 5 m/s. Further, as shown in FIG. 1, a load was applied in a length direction of the housing block R. Further, automatic transmission fluid (ATF) having a temperature of about 60° C. was supplied as oil between the bearing Ps mounted on the housing block R and the test shaft H.

Furthermore, the load increases stepwise from 150 N. That is, the test was performed such that the test shaft H was rotated for 5 minutes in a state where the load was constant, and, after an elapse of 5 minutes, the load increased to a predetermined level. The test shaft H is set in a state of partial contact with the bearing Ps. That is, the test shaft H and the housing block R are set such that the test shaft H and a cylindrical shaft of the bearing Ps are inclined to each other by a certain angle. An amount of partial contact is configured to be the same among Examples 1 to 12 and Comparative Examples 1 to 5.

In the present embodiment, the surface pressure at seizure was measured by the above tester. Here, the surface pressure at seizure is a surface pressure when a predetermined temperature (a temperature at which seizure is assumed to have occurred) is reached. The temperature can be measured by a temperature sensor or the like attached to the bearing Ps or the housing block R. This test is performed in a state of partial contact, and the surface pressure is specified by acquiring a projected area of a contact portion from an image obtained by cutting the bearing Ps in half after the test and photographing a partial contact portion from a vertical upper side, and dividing the applied load by the projected area.

Abrasion depth is a result of an abrasion resistance test (abrasion depth measurement test). The abrasion resistance test was performed by a block-on-ring test. That is, the copper alloy sliding material was formed on the rectangular parallelepiped base material in the above-described manufacture direction method, and the block-on-ring test was performed by the block. Various known testers may be used as the block-on-ring tester.

In this example, the block has a size of 15 mm in length, 10 mm in width, and 2 mm in thickness, and the ring has a size of 40 mm in diameter. A material for the ring is S45C (carbon steel). A relative sliding speed between the block and the ring is 0.5 m/s, and the load is 90 N. A test time was 30 minutes, the temperature was room temperature, and automatic transmission fluid (ATF) was used as the oil. The test was performed in a direction in which a sliding mark was formed in a width direction of the block, and the abrasion depth was measured on the surface of the copper alloy sliding material after the test. The abrasion depth is an average value of depths measured at three points in the width direction (2.5 mm, 0.5 mm, and 7.5 mm from an end) by straightening the surface of the copper alloy sliding material with a surface roughness measuring machine (SE-3400 manufactured by Kosaka Laboratory Ltd.).

According to the test performed as described above, it is found that, in Examples 1 to 12, both the seizure resistance and the abrasion resistance are good as compared with those of Comparative Examples 1 to 5. Specifically, in Examples 1 to 12, the surface pressure at seizure is 60 MPa or more in many samples, but there is no sample in which the surface pressure at seizure reaches 60 MPa in Comparative Examples 1 to 5. The surface pressure at seizure in Example 5 is 57 MPa, which was a sufficiently large value, and the abrasion depth in Example 5 is 1.9 μm. The value 1.9 μm as the abrasion depth is very good. Therefore, in Example 5, both the seizure resistance and the abrasion resistance are good.

Figure 2A:
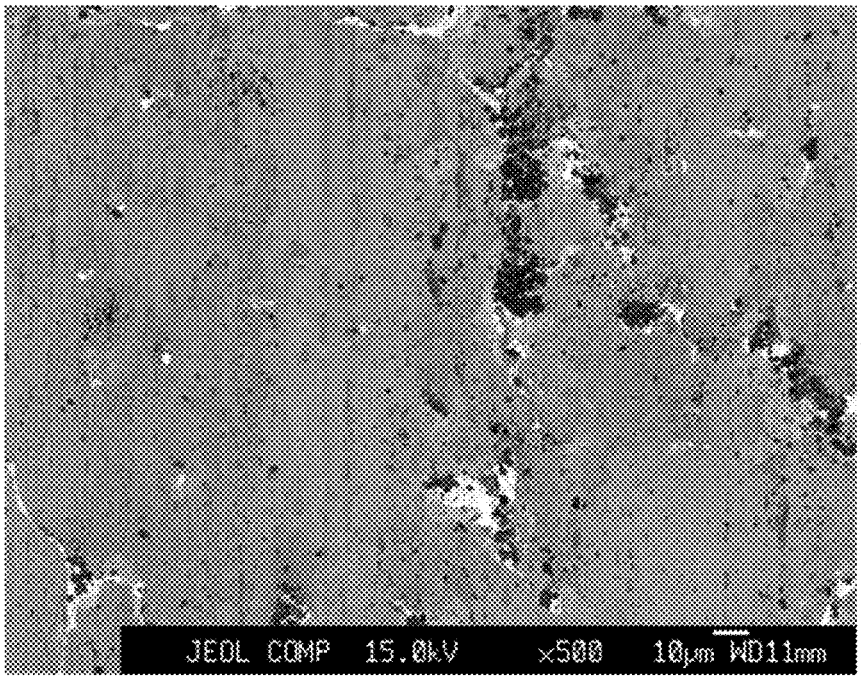
FIG. 2A is a view showing a result of seizure resistance test in an Example.
Figure 2B:
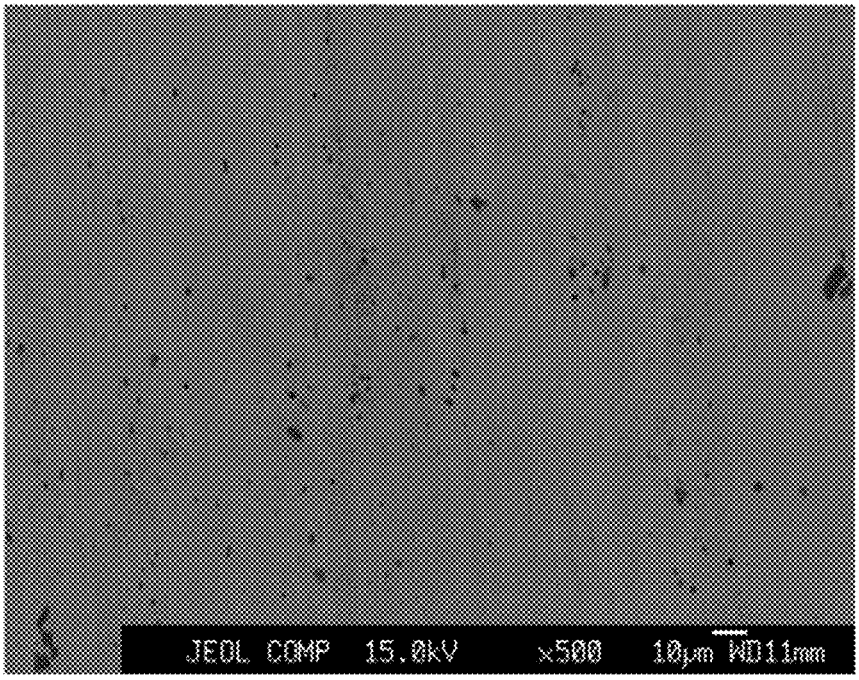
FIG. 2B is a view showing a result of a seizure resistance test in an Example.

FIGS. 2A and 2B are SEM photographing results showing results of the seizure resistance test, and are observation images at a magnification of 500 times of the partial contact portion. FIG. 2A shows the result after the test of Example 12, and FIG. 2B shows the result after the test of Comparative Example 1. In both the figures, gray represents a Cu alloy, black represents an inorganic compound, and white represents Bi. Comparing the figures, Bi remains on the surface in Example 12, but Bi does not remain on the surface in Comparative Example 1. Therefore, it is considered that the lubricating action for low-melting-point soft metals due to Bi was obtained in Example 12, but that the lubricating action for low-melting-point soft metals due to Bi was not obtained in Comparative Example 1, and that, as a result, a large difference occurred in the surface pressure at seizure, as shown in Table 1.

Furthermore, in Examples 1 to 12, the abrasion depth is 3.0 μm or less in all the samples, many samples have an abrasion depth on the order of 2 μm, and there are also samples having an abrasion depth of 2.0 μm or less. On the other hand, in Comparative Examples 1 to 5, there is no sample having an abrasion depth of less than 2.8 μm. All the samples other than that of Comparative Example 4 have an abrasion depth of 3.0 μm or more.

Comparative Example 4 having an abrasion depth of 2.8 μm has a surface pressure at seizure of 50 MPa, which is inferior to any of Examples 1 to 12. Therefore, when Examples 1 to 12 are compared with Comparative Examples 1 to 5, it can be said that Examples 1 to 12 are samples in which both the seizure resistance and the abrasion resistance are achieved at a high level.

Furthermore, in Comparative Example 1, the inorganic compound used is one type $Fe_3P$, and the average particle size is as large as 12.0 μm. It is considered that, since Comparative Example 1 does not contain the first inorganic compound having a small average particle size, the plastic flow of Cu cannot be suppressed due to this influence, and that the surface pressure at seizure becomes a significantly small value. In addition, the hardness of the inorganic compound $Fe_3P$ of Comparative Example 1 is equivalent to 800 HV, and is smaller than those of the other samples. In addition, its overall material hardness is also smaller than those of the other samples. As a result, the abrasion of the sample when it comes into contact with the counter material is larger than those of the other samples, and its abrasion depth is 9.0 μm, which is significantly larger than those of the other samples.

Furthermore, in Comparative Example 2, the inorganic compound used is one type $Mo_2C$, and the average particle size is as small as 2.0 μm. Therefore, the surface pressure at seizure is higher than that of Comparative Example 1, but is the lowest level of surface pressure as compared with those of Examples 1 to 12. The abrasion depth is also the lowest level of abrasion depth as compared with Examples 1 to 12. In any of Examples 1 to 12, there is no sample in which both the surface pressure at seizure and the abrasion depth are at the lowest levels as described above at the same time, and it is found that a material containing the second inorganic compound is better in this sense.

In Comparative Example 3, the amount of Sn is 15.0 mass %. As a result, the strength of the Cu matrix is insufficient, and thus the surface pressure at seizure is as small as 40 MPa, and the abrasion resistance is 3.1 μm, which is not so small. In Comparative Example 4, the amount of Bi was 10.0 mass %. As a result, the lubricating action for low-melting-point soft metals due to Bi cannot be used due to the decrease in Bi on the sliding surface, and the surface pressure at seizure is as small as 50 MPa.

Furthermore, in Comparative Example 5, the value obtained by dividing the volume fraction of the first inorganic compound by the volume fraction of the second inorganic compound is 1.6. Therefore, the first inorganic compound is excessively added to the second inorganic compound, as compared with Examples 1 to 12. For this reason, the bonding between the Cu alloy powders is inhibited, and the Cu alloy is likely to fall off (abrade) due to contact friction. In addition, a total amount of the inorganic compounds added is less than 1.0 mass %, and thus it is difficult to obtain improvement in abrasion resistance by the inorganic compound. As a result, the abrasion depth is as large as 3.4 μm.

As described above, Comparative Examples 1 to 5 are inferior to Examples 1 to 12 in at least one of seizure resistance and abrasion resistance. Therefore, in Examples 1 to 12, the seizure resistance and the abrasion resistance can be improved together.

(3) Other Embodiments

The copper alloy sliding material according to the present invention can be used in various sliding members in addition to the bearing illustrated in the above-described embodiment. For example, a radial bearing such as a transmission gear bush or a piston pin bush/boss bush may be formed by the copper alloy sliding material of the present invention. In addition, the application of the bearing is also not limited, and the bearing may be a sliding bearing for bearing a crankshaft of an engine, or a sliding bearing for other applications may be formed. The base material may be any member on which the copper alloy sliding material is formed, and its composition, shape, and the like are not limited.

Further, the copper alloy sliding material may contain an additive. Specifically, a copper alloy sliding material may be configured, which contains 0.5 to 12.0 mass % of Sn, 2.0 to 8.0 mass % of Bi, 1.0 to 5.0 vol % of an inorganic compound, and an additive, the balance being Cu and inevitable impurities, wherein the inorganic compound includes a first inorganic compound having an average particle size of 0.5 to 3.0 μm and a second inorganic compound having an average particle size of 4.0 to 20.0 μm, and wherein a value obtained by dividing a volume fraction of the first inorganic compound by a volume fraction of the second inorganic compound is 0.1 to 1.0.

Examples of the additive include various materials. For example, an element such as Al, Ni, Zn, Fe, Ag, or P may be used as the additive. An amount of the additive is assumed to be about 5 mass % in total. For example, when at least one of Al, Ni, and Zn is added, the strength of the Cu matrix can be improved. In this case, these additives may be added together with Sn, or may be added instead of Sn. In the latter case, the amount of Sn is less than 0.5 to 12.0 mass %. When Ag is added in an amount of, for example, about 0.15 mass %, improvement in seizure resistance is expected. When P is added in an amount of, for example, about 0.1 mass %, improvement in sinterability is expected.

Furthermore, the method for manufacturing the copper alloy sliding material in the above-described embodiment is an example, and some of the steps may be altered, changed in order, omitted, or the like. For example, powders of Cu, Sn, Bi, and the inorganic compound may be mixed. At least one of the rollings may be omitted, or the conditions may be altered.

Furthermore, the first inorganic compound and the second inorganic compound may be the same substance (having the same composition of elements) or different kinds of substances (substances different in at least one of elements and composition). Furthermore, at least one of the first inorganic compound and the second inorganic compound may be two kinds of substances. For example, at least one of the first inorganic compound and the second inorganic compound may be composed of different kinds of substances having an average particle size within the same range.

Figure 3:
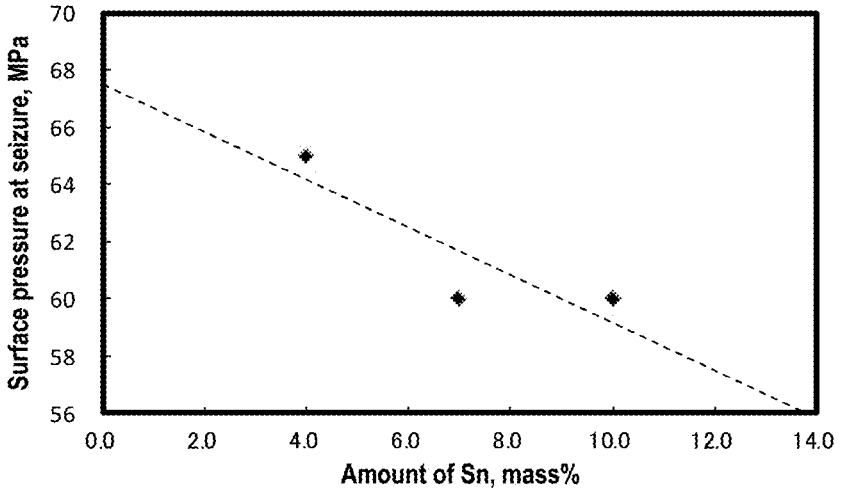
FIG. 3 is a graph showing a surface pressure at seizure with respect to an amount (mass %) of Sn.

In Table 1 shown above, an upper limit value of the mass % of Sn is 10.0 mass %, but it is considered that Sn may be contained in an amount of up to 12.0 mass %. FIG. 3 is a graph showing the surface pressure at seizures with respect to the amounts (mass %) of Sn of the samples of Examples 1 to 3. When the values are linearly approximated by the least squares method (broken line), the amount of Sn required to attain a range of surface pressure at seizure (57 MPa or more) assumed as the Examples is more than 12.0 mass %. Therefore, it is considered that, even in a case where the amount of Sn increases to 12.0 mass %, the case is an example of the present invention.

Furthermore, the inorganic compound is not limited to TiN and $Cr_2N$ described above. That is, another nitride may be used. In addition, the inorganic compound is not limited to a nitride, and may be, for example, a carbide, a boride, a silicide, or the like. It is considered that, when the hardness of the inorganic compound is high, the inorganic compound contributes to reduction in abrasion depth. In Comparative Example 1 in Table 1, the inorganic compound after conversion has a Vickers hardness of 800, which is smaller than those of the other samples. Therefore, it is considered that, if the inorganic compound is harder than that in Comparative Example 1, the abrasion resistance is improved than that in Comparative Example 1.

Therefore, an inorganic compound having a Vickers hardness of more than 800, for example, a nitride, a carbide, a boride, or a silicide having a Vickers hardness of more than 1000, as shown in Table 2, can be used as an embodiment of the present invention. It is considered that the higher the Vickers hardness of the inorganic compound is, the higher the effect of improving the abrasion resistance is. Therefore, among the inorganic compounds shown in Table 2, the inorganic compounds having a Vickers hardness of more than 1100 are preferred, and the inorganic compounds having a Vickers hardness of more than 1200 are more preferred. The inorganic compounds having a Vickers hardness of more than 1400 are further preferred. In Table 2, the average particle size of the powder commercially available as each inorganic compound is exemplified. As described above, various compounds can be selected as the inorganic compounds, a commercially available compounds having various average particle sizes can be selected as the first inorganic compound and the second inorganic compound.

TABLE 2

| | Inorganic compound | Hardness, GPa | Conversion into HV | Average particle size (μm) | | | |
|---|---|---|---|---|---|---|---|
| Carbide | TiC | 31.1 | 2874 | 1.00 to 2.00 | 0.9 to 1.5 | | |
| | ZrC | 28.9 | 2670 | 1.00 to 3.99 | 4.00 to 8.00 | | |
| | VC | 24.3 | 2245 | 1.00 to 3.00 | | | |
| | NbC | 21.3 | 1968 | 1.00 to 3.00 | | | |
| | $Cr_3C_2$ | 17.7 | 1635 | | | | |
| | $Mo_2C$ | 14.7 | 1358 | 1.00 to 1.99 | 2.00 to 3.99 | | |
| | $W_2C$ | 29.4 | 2717 | | | | |
| Nitride | TiN | 20.1 | 1857 | 0.7 to 1.19 | 1.2 to 1.8 | 1.0 to 1.5 | 1.5 to 2.5 |
| | ZrN | 16.5 | 1525 | 1.0 to 2.0 | | | |
| | VN | 12.8 | 1183 | 4.0 to 7.0 | | | |
| | NbN | 14.3 | 1321 | 4.0 to 7.0 | | | |
| | TaN | 23.7 | 2190 | 2.0 to 5.0 | | | |
| | $Cr_2N$ | 15.4 | 1423 | 4.0 to 7.0 | | | |
| Boride | $TiB_2$ | 33.0 | 3049 | 2.50 to 4.50 | 1.00 to 2.00 | | |
| | $ZrB_2$ | 20.6 | 1903 | 3.00 to 5.00 | 1.5 to 2.5 | | |
| | $HfB_2$ | 28.4 | 2624 | 2.0 to 5.0 | | | |
| | $VB_2$ | 27.5 | 2541 | 2.0 to 5.0 | | | |
| | $NbB_2$ | 25.5 | 2356 | 1.5 to 2.5 | | | |
| | $TaB_2$ | 24.5 | 2264 | 1.0 to 1.5 | | | |
| | CrB | 12.3 | 1137 | 7.0 to 11.0 | | | |
| | $CrB_2$ | 20.6 | 1903 | 3.0 to 6.0 | | | |
| | $Mo_2B$ | 24.5 | 2264 | | | | |
| | MoB | 23.0 | 2125 | 3.0 to 6.0 | | | |
| | $Mo_2B_5$ | 23.0 | 2125 | | | | |
| | WB | 36.3 | 3354 | 3.0 to 6.0 | | | |
| | $W_2B_5$ | 26.1 | 2412 | 1.0 to 2.0 | 7.0 to 11.0 | | |
| | $LaB_6$ | 27.2 | 2513 | | | | |
| Silicide | $TaSi_2$ | 13.8 | 1275 | 5.0 to 10.0 | 2.0 to 5.0 | | |
| | $Mo_5Si_3$ | 11.5 | 1063 | 5.0 to 10.0 | 2.0 to 5.0 | | |
| | $MoSi_2$ | 11.8 | 1090 | 5.0 to 10.0 | 2.0 to 5.0 | | |
| Nitride | AlN | — | 1400 | 1.3 to 1.7 | | | |

The invention claimed is:

1. A copper alloy sliding material comprising 0.5 to 12.0 mass % of Sn, 2.0 to 8.0 mass % of Bi, and 1.0 to 5.0 vol % of an inorganic compound, the balance being Cu and inevitable impurities, wherein the inorganic compound includes a first inorganic compound which has an average particle size of 0.5 to 3.0 μm and a second inorganic compound which has an average particle size of 4.0 to 20.0 μm and is different from the first inorganic compound, and wherein a value obtained by dividing a volume fraction of the first inorganic compound by a volume fraction of the second inorganic compound is 0.1 to 1.0; and wherein the Vickers hardness of each of the first inorganic compound and the second inorganic compound is greater than 1100.

2. The copper alloy sliding material according to claim 1, wherein an amount of the first inorganic compound is 0.3 to 1.0 vol %, and an amount of the second inorganic compound is 0.5 to 4.5 vol %.

* * * * *